US005421763A

United States Patent [19]

Amburgey et al.

[11] Patent Number: 5,421,763

[45] Date of Patent: Jun. 6, 1995

[54] APPARATUS FOR PRODUCING NOISE FOR USE WITH A CHILD'S TOY

[75] Inventors: James D. Amburgey, Richardson; Peter C. Hill, Dallas, both of Tex.

[73] Assignee: Today's Kids, Inc., Booneville, Ak.

[21] Appl. No.: 13,791

[22] Filed: Feb. 5, 1993

[51] Int. Cl.[6] ..... A63H 3/28

[52] U.S. Cl. ..... 446/194; 472/98; 446/184

[58] Field of Search ..... 446/184, 188, 192–194, 446/203, 204, 206, 207, 208, 213, 216; 472/95, 98, 101

[56] References Cited

U.S. PATENT DOCUMENTS

| | | | |
|---|---|---|---|
| 1,055,681 | 3/1913 | Steiner | 446/193 |
| 1,438,108 | 12/1922 | Gund | 446/193 X |
| 2,534,996 | 12/1950 | Singer | 446/193 |
| 4,280,299 | 7/1981 | Oka | 446/206 |
| 5,074,820 | 12/1991 | Nakayama | 472/98 X |

FOREIGN PATENT DOCUMENTS

| | | | |
|---|---|---|---|
| 730438 | 5/1955 | United Kingdom | 446/184 |
| 911099 | 11/1962 | United Kingdom | 446/184 |

*Primary Examiner*—Mickey Yu

*Attorney, Agent, or Firm*—Kirkpatrick & Lockhart

[57] ABSTRACT

An apparatus is provided for use in connection with a child's toy which selectively generates a noise. The apparatus includes a chamber within a child's toy for holding a volume of air. Adjacent the chamber is a noise-making member, such as a reed, constructed to vibrate when subjected to a moving air stream. The moving air stream is created when the child sits on the toy and rocks back and forth (i.e., rides the toy). When the child rides the toy, air passes from the chamber and over the noise-making member. Surrounding the noise-making member is a tubular member for directing the air from the chamber around and past the noise-making member. The tubular member has an intake port in fluid communication with the chamber adapted to received air from the chamber and an exhaust port adapted to expel air after it has passed over the noise-making member. The apparatus also includes a control knob which supports the tubular member for selectively preventing air from passing over the noise-making member to prevent the noise-making member from producing a noise. Such control knob, when turned, takes the tubular member out of fluid communication with the chamber to prevent airflow across the noise-making member.

8 Claims, 4 Drawing Sheets

APPARATUS FOR PRODUCING NOISE FOR USE WITH A CHILD'S TOY

BACKGROUND OF THE INVENTION

1. Field of the Invention

The present invention relates to apparatus for producing noise for use in connection with a child's toy. Specifically, an apparatus is provided which selectively produces noise by vibrating a flexible element by a moving air stream.

2. Description of the Invention Background

In the past, children's toys have had associated therewith noise-making apparatus which produced noise by various means. One type of toy which is capable making a noise utilizes a moving air stream to cause a reed or other similar member to vibrate. However, such apparatus were not designed to provide noise-making and non-noise-making modes. Specifically, in such apparatus of the past, when a child took the action necessary to produce the noise (e.g. squeezed the toy), in all cases, the toy would produce the noise. In some situations, it is desirable to prevent the toy from producing the noise even when the child takes the action necessary to produce the noise.

Accordingly, an apparatus for a child's toy is needed which will produce a noise when desired and can be prevented from making a noise if so desired.

Additionally, in toys of the past which made noise by moving air streams, the moving air streams were created by a child squeezing the toy in his or her hand. Heretofore, toys which made a noise by means of a moving air did not create the moving air stream by the child rocking back and forth or moving up and down while riding the toy.

BRIEF SUMMARY OF THE INVENTION

The present invention provides a noise-making apparatus for a child's toy which overcomes the deficiencies of such apparatus in the past. In accordance with the present invention, there is provided an improved apparatus for selectively generating a noise. The apparatus includes a chamber within a child's toy for holding a volume of air. Adjacent the chamber is a noise-making member, such as a reed, constructed to vibrate when Subjected to a moving air stream. The moving air stream is created when the child sits on the toy and rocks back and forth (i.e., rides the toy). When the child rides the toy, air passes from the chamber and over the noise-making member. Surrounding the noise-making member is a tubular member for directing the air from the chamber around and past the noise-making member. The tubular member has an intake port in fluid communication with the chamber adapted to receive air from the chamber and an exhaust port adapted to expel air after it has passed over the noise-making member. The apparatus also includes means for selectively preventing air from passing over the noise-making member to prevent the noise-making member from producing a noise. Such means may include a knob which, when turned, takes the tubular member out of fluid communication with the chamber to prevent airflow across the noise-making member.

Accordingly, the present invention provides solutions to the aforementioned problems associated with noise-making apparatus for toys.

BRIEF DESCRIPTION OF THE DRAWINGS

In the accompanying drawings, we have shown a present preferred embodiment of the invention wherein.

DETAILED DESCRIPTION OF THE PREFERRED EMBODIMENTS

Figure 1:
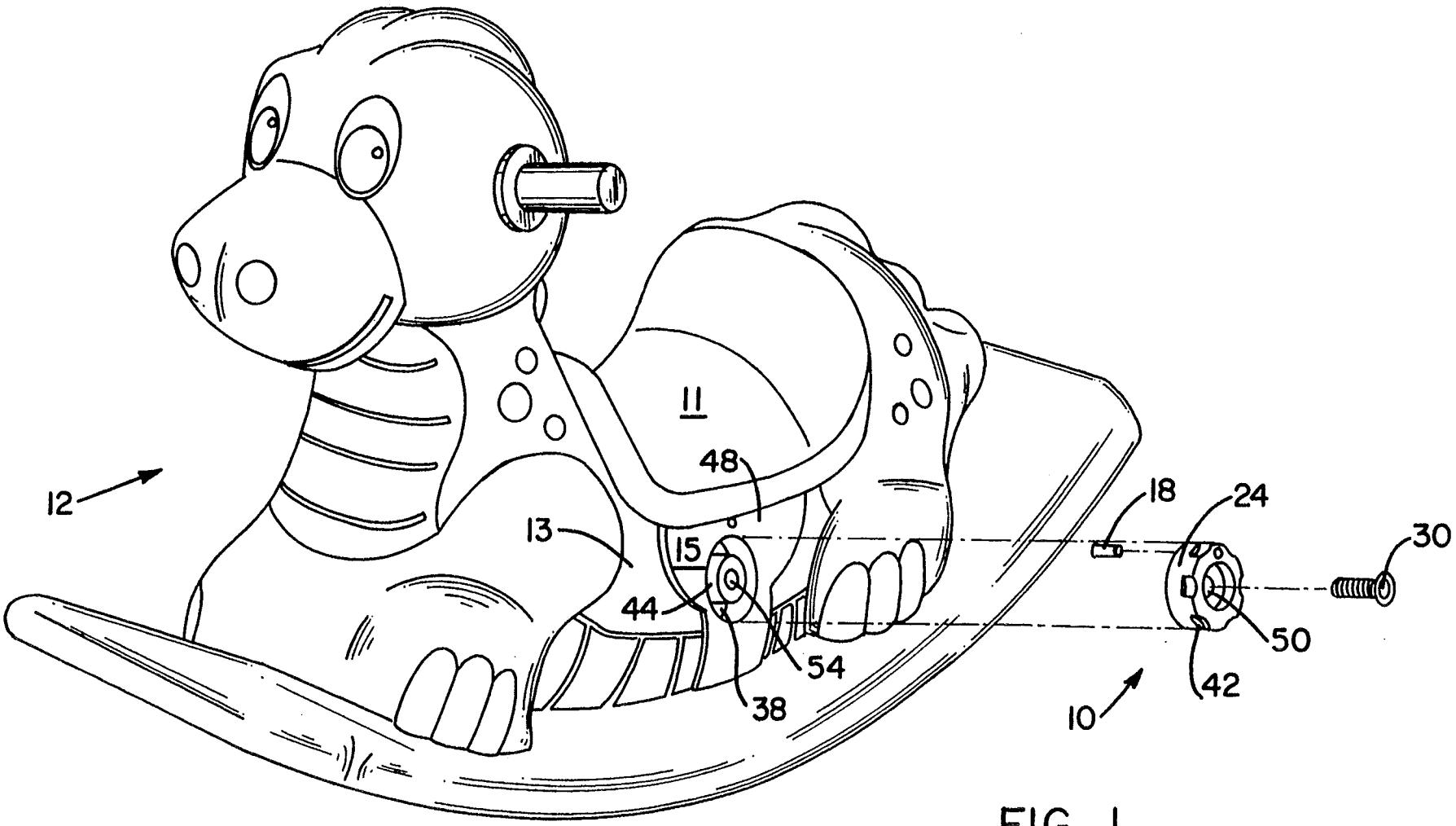
FIG. 1 is an exploded perspective view of the present invention shown in connection with a child's toy.

Referring now to the drawings wherein the showings are for purposes of illustrating the present preferred embodiments of the invention only and not for purposes of limiting same, the Figures show a noise-making apparatus, generally designated as 10.

Figure 2:
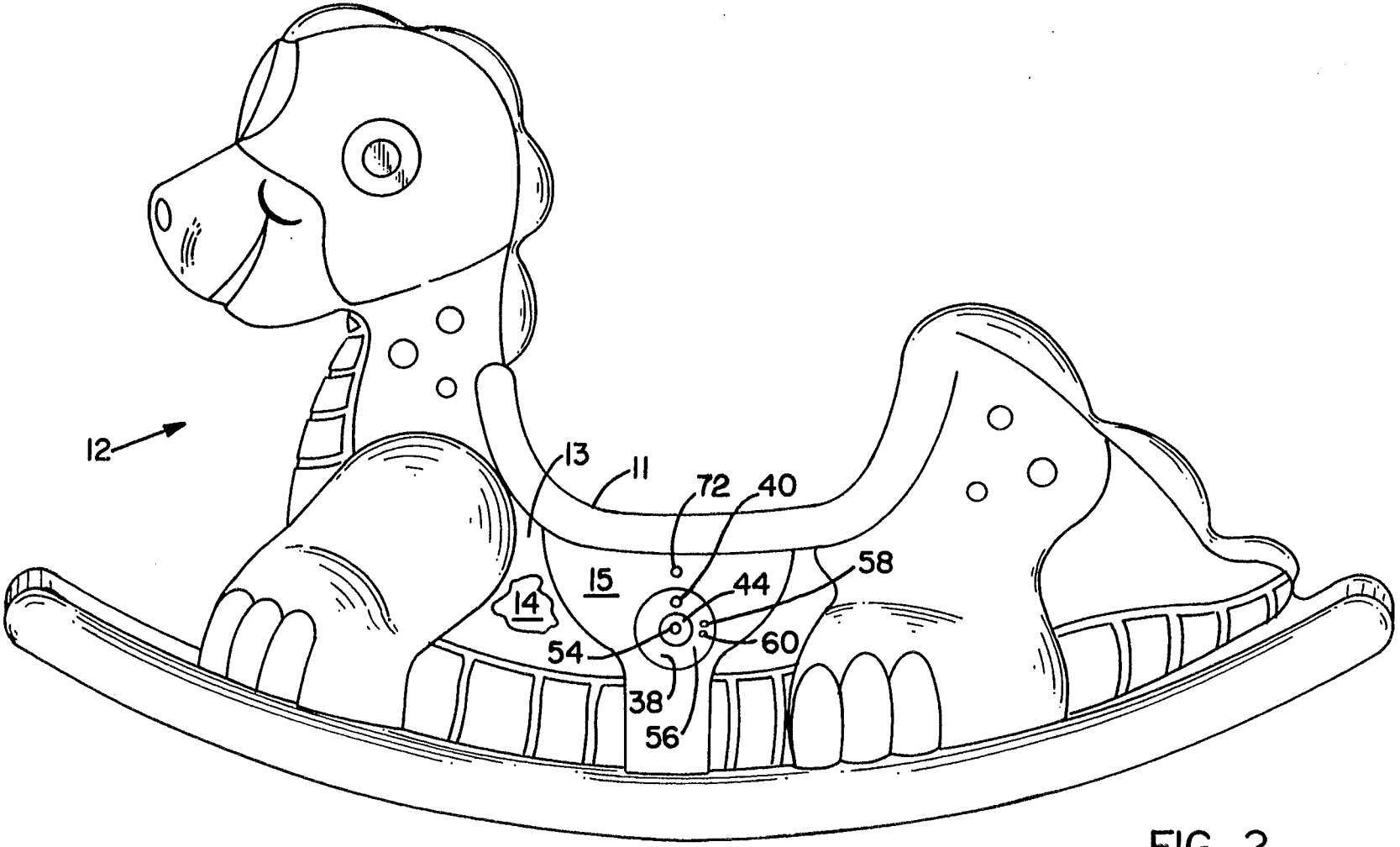
FIG. 2 is a side view of the noise-making apparatus of the present invention shown in connection with a child's toy with the control knob removed and a portion of the body cut away.

More particularly, and with reference to FIGS. 1 and 2, there is shown a child's toy 12, constructed of a flexible material such as a polymer, having a noise-making apparatus 10 connected thereto. The child's toy illustrated is a rocking dinosaur, but one of ordinary skill in the art will recognize that the toy can take one of many forms. The child's toy 12 is provided with a seat 11, flexible body or housing 13, an air chamber 14 formed therein, and an exterior surface 15. When the flexible housing 13 is deformed, as when a child sits thereon and rocks back and forth or moves up and down, the chamber 14 is capable of changes in volume.

Figure 4:
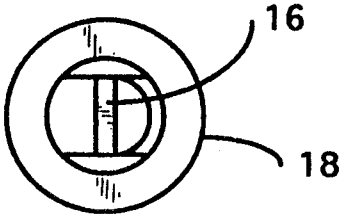
FIG. 4 is a front view of the tubular member of FIG. 3.
Figure 3:
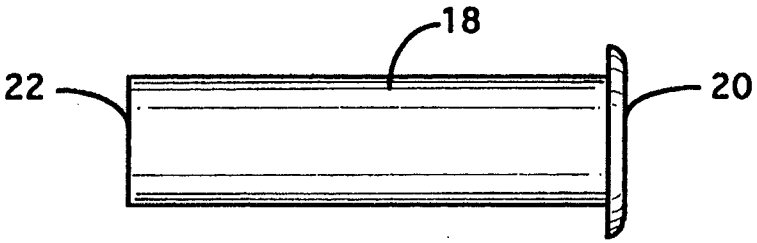
FIG. 3 is a side view of the tubular member of the present invention.

Referring now to FIGS. 3 and 4, the noise-making apparatus 10 includes a noise-making member 16, such as a reed, provided within a tubular member 18. The noise-making member 16 is attached at its longitudinal center to the tubular member 18 such that the noise-making member 16 may vibrate at either end in response to air flow in either longitudinal direction through the tubular member 18. One of ordinary skill in the art will recognize that the noise-making member 16 may be attached at various locations to the tubular member 18 along its length but is preferably attached at its longitudinal center. The noise-making member 16 produces a noise when air is forced to pass over the noise-making member 16 by the air flow causing the vibration thereof. The tubular member 18 surrounds the noise-making member 16 to direct air over the noise-making member 16. Located at one end of the tubular member is an intake port 20 capable of receiving air from an exhaust port 40 in the exterior surface 15 of chamber 14 (FIG. 2). At the other end of the tubular member 18 is exhaust port 22 capable of expelling air from the tubular member 18.

Figure 5:
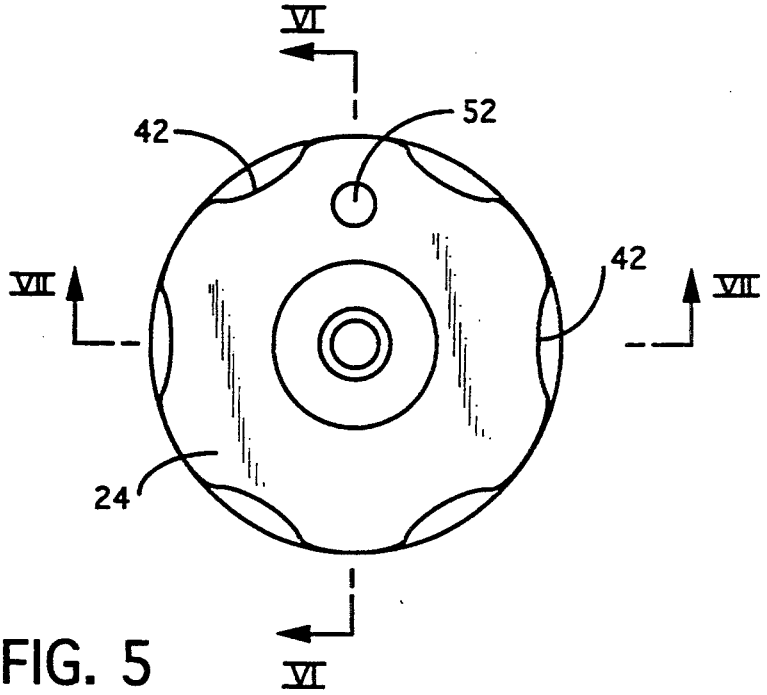
FIG. 5 is a front view of the control knob of the present invention.
Figure 6:
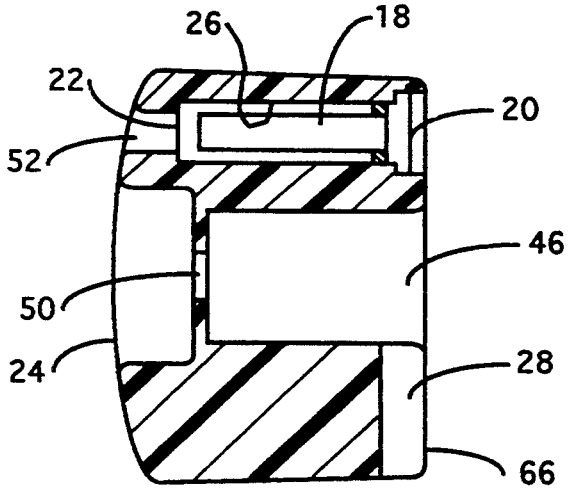
FIG. 6 is a cross-sectional view of the control knob of FIG. 5 taken along the line VI—VI.
Figure 7:
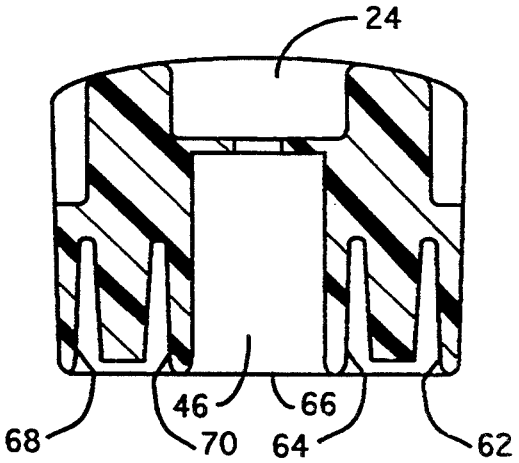
FIG. 7 is a cross-sectional view of the control knob of FIG. 5 taken along the line VII—VII.

A control knob 24, as shown in FIGS. 5–7, is provided to selectively move the tubular member 18 adjacent to and remote from exhaust port 40, and hence, moving intake port 20 into and out of fluid communication with the exhaust port 40. It is contemplated that instead of moving said tubular member 18, the intake port 20 could be blocked to prevent air flow therethrough. Although preferably a knob is utilized to move the tubular member 18 into and out of fluid communication with the exhaust port 40, other arrangements may be utilized such as, for example, sliding members or pivoting members; what is required is that the tubular member 18 be capable of being taken into and out of fluid communication with the exhaust port 40. The control knob 24 has a bore 26 therethrough which receives the tubular member 18 and holds the tubular member 18 therein by means of a press-fit. When the tubular member 18 is in alignment with the exhaust port 40, air may pass through the tubular member 18, over noise-making member 16 to cause its noise-making vibration, and be expelled through the exhaust port 26 and through an outer port 52 in the control knob 24. When the control knob 24 is rotated such that the tubular member 18 is not in alignment with the exhaust port 40, a control port 28 through the control knob 24 allows air to escape to the atmosphere from the exhaust port 40 without passing through the tubular member 18 and without making any noise.

The body 13 of the child's toy 12 has a recess 38 in the exterior surface 15 of the child's toy 12 which is sized to rotatably receive the control knob 24. The recess has a central upstanding cylinder 44 and the control knob 24 has a corresponding aperture 46 therein. The control knob 24 is, thus, recessed into the body 13 of the child's toy 12. Although it is not necessary to recess the control knob 24 into the body 13, such an arrangement is preferable. The control knob 24 is rotatably attached to the child's toy 12 by means of a pin 30 which is inserted through a bore 50 in the control knob into a corresponding bore 54 in the central cylinder 44 in the exterior surface 15 of body 13 of the child's toy 12 such that the noise-making and non-noise-making modes may be selected by a simple turn of the control knob 24. The bearing surface 56 of the recess 38 has two protrusions 58 and 60 which correspond to two ribs 62 and 64 on one side of the inner perimeter 66 of the control knob 24 and two ribs 68 and 70 on the other side of the inner perimeter of the control knob 24. When ribs 62 and 64 are aligned with protrusions 58 and 60, the control knob is held in the noise-making position. When ribs 68 and 70 are aligned with protrusions 58 and 60, the control knob is held in the non-noise-making position. Recess 72 allows a person to visually determine when the control knob 24 is in the noise-making position, as recess 72 will be aligned with outer port 52. Gripping pads 42 are recessed in the perimeter of the control knob 24 to facilitate turning of the control knob 24 by a person's hand.

In operation, a person sits on the seat 11 and either rocks back and forth or moves up and down. The movement of the person causes the volume of the chamber 14 to change.

When the control knob 24 is in the noise-making position, the intake port 20 of the tubular member 18 is in fluid communication with the exhaust port 40. As the volume decreases, air is forced out of the chamber 14 through exhaust port 40. Air thus passes into the tubular member 18 and over the noise-making member 16 within the tubular member 18. As this occurs, the noise-making member 16 vibrates to make a noise. Air then passes out of exhaust port 22 to the atmosphere. As the volume of air inside the chamber 14 increases, and the intake port 20 is in fluid communication with the exhaust port 40, air is taken in through exhaust port 22 and passes over the noise-making member 16 to generate a noise. Air then flows out of the intake port 20 and into the chamber 14 through exhaust port 40.

When the control knob 24 is turned to the non-noise-making position, the exhaust port 40 is not in fluid communication with the intake port 20 but is in fluid communication with the control port 28. As the volume of air decreases in the chamber 14, air is forced out of the exhaust port 40, into the control port 28 and is expelled to the atmosphere without making a noise. As the volume of air in the chamber 14 increases, air is taken in from the atmosphere through control port 28 and enters the chamber 14 through the exhaust port 40 without generating a noise.

It will be understood that various changes in the details, materials and arrangements of parts, which have been herein described and illustrated in order to explain the nature of the invention, may be made by those skilled in the art within the principle and scope of the invention as expressed in the appended claims.

What is claimed is:

1. An apparatus for selectively generating a noise, comprising:

a flexible housing having an interior chamber adapted to hold a volume of air, said chamber capable of changes in volume when subjected to an external force, said chamber having a first exhaust port for expelling air when the volume of air in said chamber is reduced and said flexible housing including a recessed portion;

a noise-making member constructed to vibrate to produce a noise when subjected to a moving air stream passing from said chamber and over said noise-making member;

means for directing said moving air stream over said noise-making member, said means for directing being capable of being placed in fluid communication with said first exhaust port, said means for directing having an intake port adapted to receive said air from said first exhaust port of said chamber when said chamber is subjected to an external force and when said intake port is in fluid communication with said first exhaust port, said means for directing having a second exhaust port adapted to expel said air from said means for directing, said noise-making member operatively attached to said means for directing; and means for selectively preventing fluid communication between said means for directing and said first exhaust port to prevent said moving air stream from passing over said noise-making member, said means for selectively preventing fluid communication including a control member attached within said recessed portion of said flexible housing, said control member including a control port capable of being placed in fluid communication with said first exhaust port such that said moving air stream passes into said control port and is exhausted to the atmosphere without making a noise.

2. The apparatus of claim 1 wherein said control member is rotatably attached to said flexible housing and said control member is adapted to be rotatable between a noise-making position wherein said first exhaust port is in fluid communication with said intake port and a non-noise-making position wherein said first exhaust port is in fluid communication with said control port.

3. The apparatus of claim 2 wherein the means for directing includes a tubular member having an internal passageway.

4. A child's toy, comprising:

a toy body having a flexible housing with an interior chamber adapted to hold a volume of air, said chamber capable of changes in volume when subjected to an external force, said chamber having a first exhaust port for expelling air when the volume of air in said chamber is reduced, said flexible housing including a recessed portion;

a noise-making member constructed to vibrate to produce a noise when subjected to a moving air stream passing from said chamber and over said noise-making member;

means for directing said moving air stream over said noise-making member, said means for directing being capable of being placed in fluid communication with said first exhaust port, said means for directing having an intake port adapted to receive said air from said first exhaust port of said chamber when said chamber is subjected to an external force and when said intake port is in fluid communication with said first exhaust port, said means for directing having a second exhaust port adapted to expel said air from said means for directing, said noise-making member operatively attached to said means for directing; and means for selectively preventing fluid communication between said means for directing and said first exhaust port to prevent said moving air stream from passing over said noise-making member said means for selectively preventing fluid communication including a control member attached within said recessed portion of said flexible housing, said control member including a control port capable of being placed in fluid communication with said first exhaust port such that said moving air stream passes into said control port and is exhausted to the atmosphere without making a noise.

5. A child's toy, comprising:

a toy body having a flexible housing with an interior chamber adapted to hold a volume of air, said chamber capable of changes in volume when subjected to an external force, said chamber having a first exhaust port for expelling air when the volume of air in said chamber is reduced, said flexible housing of said toy body including a recessed portion;

a noise-making member constructed to vibrate to produce a noise when subjected to a moving air stream passing from said chamber and over said noise-making member;

means for directing said moving air stream over said noise-making member, said means for directing being capable of being placed in fluid communication with said first exhaust port, said means for directing having an intake port adapted to receive said air from said first exhaust port of said chamber when said chamber is subjected to an external force and when said intake port is in fluid communication with said first exhaust port, said means for directing having a second exhaust port adapted to expel said air from said means for directing, said noise-making member operatively attached to said means for directing; and means for selectively preventing fluid communication between said means for directing and said first exhaust port to prevent said moving air stream from passing over said noise-making member, said means for selectively preventing fluid communication including a control member rotatably attached within said recessed portion of said flexible housing adjacent to said first exhaust port, said control member having a bore to receive said means for directing, said control member further having a control port angularly displaced from said bore, said control member adapted to be rotatable between a noise-making position wherein said first exhaust port is in fluid communication with said intake port and a non-noise-making position wherein said first exhaust port is in fluid communication with said control port such that when said control member is in said noise-making position, said moving air stream passes over said noise-making member, and when said control member is in said non-noise-making position, said moving air stream passes into said control port and is exhausted to the atmosphere without making a noise.

6. The apparatus of claim 5 wherein said recessed portion includes central cylinder having a bore therethrough, said control member includes an aperture corresponding to said central cylinder and a bore through said control member to receive a pin adapted to be received by said bore in said central cylinder, such that said control member may rotate about an axis through said pin.

7. The apparatus of claim 6 wherein said means for directing includes a tubular member having an internal passageway.

8. A child's toy, comprising:

a toy body having a flexible housing having a seat, a recessed portion and an interior chamber adapted to hold a volume of air, said chamber capable of changes in volume when subjected to the movement of a person seated on said seat, said chamber having a first exhaust port for expelling air when the volume of air in said chamber is reduced below a steady state quantity;

a noise-making member constructed to vibrate when subjected to a moving air stream passing from said chamber and over said noise-making member;

means for directing said moving air stream over said noise-making member, said means for directing in fluid communication with said first exhaust port, said means for directing having an intake port adapted to receive said air from said first exhaust port of said chamber when said seat is subjected the movement of a person seated thereon and a second exhaust port adapted to expel said air from said means for directing, said noise-making member operatively attached to said means for directing; and means for selectively preventing fluid communication between said means for directing and said first exhaust port to prevent said moving air stream from passing over said noise-making member including a control member attached within said recessed portion of said flexible housing, said control member including a control port capable of being placed in fluid communication with said first exhaust port such that said moving air stream passes into said control port and is exhausted to the atmosphere without making a noise.

* * * * *